United States Patent [19]

Wagner

[11] 4,108,573

[45] Aug. 22, 1978

[54] VIBRATORY TUNING OF ROTATABLE BLADES FOR ELASTIC FLUID MACHINES

[75] Inventor: John T. Wagner, Upper Darby, Pa.

[73] Assignee: Westinghouse Electric Corp., Pittsburgh, Pa.

[21] Appl. No.: 762,545

[22] Filed: Jan. 26, 1977

[51] Int. Cl.[2] ..... F01D 5/10

[52] U.S. Cl. ..... 416/236 A; 416/500

[58] Field of Search ..... 416/236, 236 A, 500

[56] References Cited

U.S. PATENT DOCUMENTS

| | | | |
|---|---|---|---|
| 1,861,065 | 5/1932 | Poot | 416/236 A X |
| 2,238,749 | 4/1941 | Peltier | 416/236 A X |
| 2,532,753 | 12/1950 | Beman | 416/236 A X |
| 2,650,752 | 9/1953 | Hoadley | 416/236 X |
| 2,899,128 | 8/1959 | Vaghi | 416/236 A X |
| 3,193,185 | 7/1965 | Erwin et al. | 416/236 A X |
| 3,572,962 | 3/1971 | Embleton et al. | 416/236 A X |
| 3,776,363 | 12/1973 | Kuethe | 416/236 A X |

FOREIGN PATENT DOCUMENTS

| | | | |
|---|---|---|---|
| 910,191 | 5/1946 | France | 416/236 A |
| 850,543 | 7/1960 | United Kingdom | 416/236 A |

*Primary Examiner*—Everette A. Powell, Jr.
*Attorney, Agent, or Firm*—F. J. Baehr, Jr.

[57] ABSTRACT

Rotatable blades are tuned by forming a plurality of ribs on concave air foil surfaces of the blades adjacent trailing edges in longitudinal alignment with the fluid flow.

1 Claim, 7 Drawing Figures

VIBRATORY TUNING OF ROTATABLE BLADES FOR ELASTIC FLUID MACHINES

BACKGROUND OF THE INVENTION

This invention relates to vibratory tuning of rotating blades and more particularly to tuning such blades to reduce vibration of their trailing edges.

As turbine blades rotate, they are subjected to intermittent forces as they pass the stationary blades thus providing continual excitation, which results in high frequency vibration. The trailing edges of the blades, which are relatively thin, are particularly susceptible to such vibration which in one mode or form is termed panel modes and includes an infinite series of vibrations within this mode.

It is difficult to avoid resident excitation when the blades are long as the natural frequencies span a considerable range and there are a multiplicity of disturbances to excite vibration. By controlling the natural frequency in the panel mode resonant excitation of the trailing edges of the blades can be avoided by selecting numbers of stationary blades which will not result in natural frequency excitation.

SUMMARY OF THE INVENTION

In general, a rotatable blade which is fastened to a rotor in an elastic fluid axial flow machine, when made in accordance with this invention, comprises a root portion by which the blade is fastened to the rotor, an air foiled shaped portion extending generally radially and outwardly from the root. The air foil portion has a leading and a trailing edge and generally concave and convex surfaces extending therebetween. The concave surface has a plurality of ribs generally longitudinally aligned with the flow of elastic fluid across the concave surface and extending from adjacent the trailing edge to an intermediate portion of the concave surface relative to the leading and trailing edges, whereby the vibration of the trailing edge will be reduced. The ribs are only disposed on the concave side and aligned with the flow in order to minimize aerodynamic losses.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENT

Figure 1:
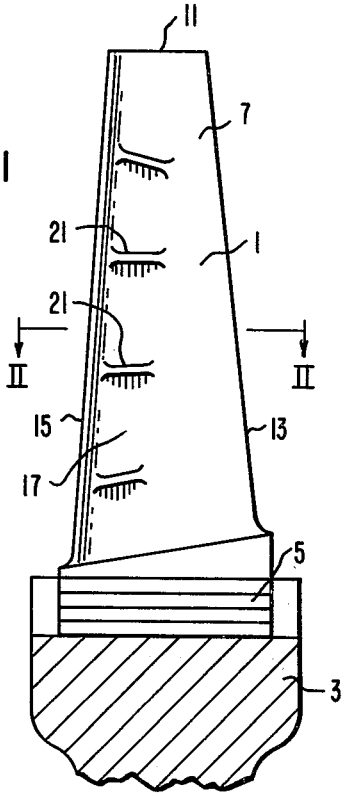
FIG. 1 is a partial sectional view of a turbine rotor showing a rotatable blade made in accordance with this invention.

Referring now to the drawings in detail and in particular to FIG. 1, there is shown a rotatable blade 1 of a stream turbine (not shown) attached to a portion of a rotor 3. The blade 1 is the side entry variety having a Christmas tree shaped root portion 5 which fits into a groove in the rotor 3. Extending radially and outwardly from the root portion 5 is an air foil portion 7 which terminates at a tip portion 11. The air foil portion 7 has a leading and trailing end 13 and 15, respectively. Concave and convex surfaces 17 and 19, respectively, are disposed between the leading and trailing edges 13 and 15 and form a curved air foil.

A plurality of ribs 21, four in the embodiment shown, are disposed on the concave surface 17 adjacent the trailing edge 15. The ribs 21 are elongated nodules longitudinally aligned with the fluid flow as it passes over the concave surface 17 of the blade 1. The nodules or ribs 21 have one end disposed adjacent the trailing edge 15 and extend inwardly toward the leading edge 13 to an intermediate location intermediately disposed between the leading and trailing edges 13 and 15, respectively. The height of the nodules or ribs 21 diminish to approximately 0 at each end and has a rounded cross section with fillets blending into the concave surface 17.

Figure 6:
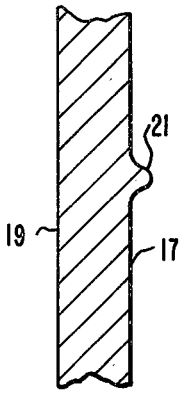
FIG. 6 is a partial sectional view taken on line VI—VI of FIG. 2.
Figure 4:
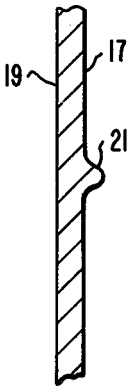
FIG. 4 is a partial sectional view taken on line IV—IV of FIG. 2.
Figure 5:
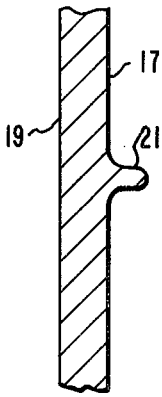
FIG. 5 is a partial sectional view taken on line V—V of FIG. 2.

FIGS. 4 through 6 show that the nodules or ribs 21 are generally symmetrical about a plane disposed generally normal to the concave surface 17.

Figure 7:
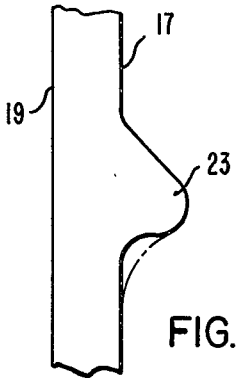
FIG. 7 is a partial sectional view similar to FIG. 5 showing an alternate rib cross section.
Figure 2:
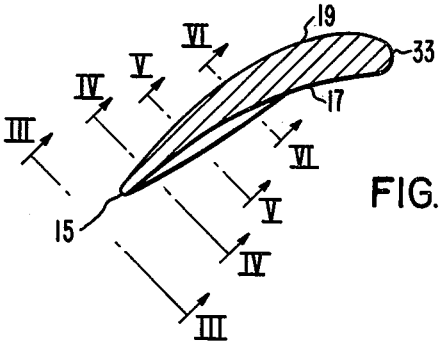
FIG. 2 is a sectional view taken on line II—II of FIG. 1.

FIG. 7 shows an alternate nodule or rib 23 having as asymmetrical cross section in order to minimize flow separation for radially flowing fluid.

Figure 3:
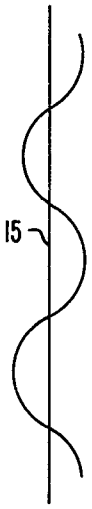
FIG. 3 is a partial sectional view taken on line III—III of FIG. 2 showing one mode of vibration of the trailing edge of the blade.

The ribs 21 hereinbefore described generally control the frequency at the trailing edge of the blade in the panel modes of vibration and as shown in FIG. 3, the blade with the rib will generally vibrate at a frequency having nodes which correspond to the location of the ribs and be setting the number of stationary blades so as not to provide excitation at these frequencies, the vibration of the trailing edge of the blade in the panel modes will not become resonant. The trailing edge of the blades may be tuned to panel modes of vibration, that is the frequencies may be set at frequencies other than the natural or resonant frequencies of the trailing edges.

What is claimed is:

1. A method for tuning an array of rotatable blades each having an airfoil portion with concave and convex surfaces which come together at leading and trailing edges and are disposed immediately downstream of an array of stationary blades, the method comprising the steps of:

providing ribs on the concave surface of the rotatable blades, the ribs being generally disposed parallel to the flow of fluid across the rotatable blades and extending from the trailing edge to the intermediate portion of the concave surface so that the trailing edge of the rotatable blades are tuned to vibrate at known frequencies, and setting the number of stationary blades in the array of stationary blades at a number which will produce excitation at a frequency that will not correspond to the known frequencies of the trailing edge of the rotatable blades.

* * * * *